United States Patent [19]

Harris

[11] Patent Number: 4,682,422

[45] Date of Patent: Jul. 28, 1987

[54] BOWLERS' HAND-DRYING BAG

[76] Inventor: Bob Harris, 7396 Van Buren St., Ventura, Calif. 93003

[21] Appl. No.: 885,668

[22] Filed: Jul. 15, 1986

[51] Int. Cl.[4] ..... F26B 5/16

[52] U.S. Cl. ..... 34/9; 34/95; 502/439; 210/484

[58] Field of Search ..... 210/484, 777; 502/407, 502/439; 34/95, 9

[56] References Cited

U.S. PATENT DOCUMENTS 4,588,505 5/1986 Walley et al. ..... 34/95

*Primary Examiner*—Larry I. Schwartz

*Attorney, Agent, or Firm*—Milton S. Gerstein

[57] ABSTRACT

A drying bag for use by a bowler in order to dry his hand before approach and delivery. A bag made of 100% polyester tricot knitted fabric of 32 gauge is filled with fuller's earth sericitic clay. The fine pores of the tricot fabric allow for escape and effusion of the dust in the bag created after shaking the bag with its contents. The polyester yarn used is between 15 and 45 denier, and the bag size is seven inches by seven inches, which is filled with the fuller's earth sericitic in the range of between 2.25 ounces and 3.50 ounces, with three ounces being preferred.

8 Claims, No Drawings

BOWLERS' HAND-DRYING BAG

BACKGROUND OF THE INVENTION

The present invention is directed to a bowler's aid for keeping his or her hands dry and free of moisture for preventing the slippage of a bowling ball from the hand during lane-approach and delivery. It is common for a bowler to continually dry his or her hand just before taking up the bowling ball for lane-approach, and delivery. This is done in order to prevent, as best as possible, any slippage of the ball from the fingers and hand, so that correct follow-through and placement of the ball on the alley guide-arrows may be achieved in a consistent and accurate manner. Presently-used techniques for keeping the hands dry of moisture are the use of a blower-fan typically provided at each lane-site, or rosin bags. While the use of the blower-fan offers some benefit to the drying of the hand, it is a time-consuming procedure, and one that cannot evaporate all of the moisture on the hand, especially when bowlers are rushed to approach the lane for delivery. The rosin bag offers better drying of the hand, but it is a very messy procedure, since the particulates from the interior of the bag escape and create a mess at the lane-site, which has led many bowling establishments to ban the use of rosin bags entirely. The present invention is directed to a bag for drying the hand of the bowler, which has at least as good as a result as a rosin bag, yet does not create the floating and contaminating fine particulates of the rosin bag.

SUMMARY OF THE INVENTION

It is, therefore, the primary objective of the present invention to provide a bowler's aid for drying the hand, which is not messy, and is quick-acting and safe to use.

It is another objective of the present invention to provide such a bowler's aid in a fine-porous bag that allows the aid to be used easily in the same manner that conventional rosin bags are currently-used, with at least as good as a result as a rosin bag.

It is yet another objective of the present invention to provide such a bowler's aid for drying the hand that is easily grasped by a hand, and held snugly therein and squeezed thereby to increase the drying and moisture-evaporating characteristics of the bowler's aid.

Toward these and other ends, the present invention is made of a small rectangular-bag, approximately four inches long and three inches wide, in which is provided the compound Fuller's Earth sericitic clay. The bag itself is made preferably from 32 gauge, 2-bar flat-tricot knitted fabric, having a yield of 4.10 ounces/yard, and made preferably from 100% polyester yarn between 20 and 40 denier. This quality of fabric has been found to offer the best clay-dust penetration therethrough, in the proper amounts, such that enough of the clay, in the form of dust particulates, is allowed to escape through the fabric to cause drying of the hand, yet not enough as to create a mess of unsightly appearance.

DETAILED DESCRIPTION OF THE INVENTION

The invention is a combination of a specific type of friable, non-sticky clay compound, described below in detail, contained in a closed bag which allows the clay particulates to seep therethrough when the bag is shaken, so that the clay particulates emanate as a fine dust, which quickly and effectively dry the hand of the user holding and shaking the bag therein. To allow for the proper escape and emanation of the find clay dust, it has been found that 2-bar, tricot knitted fabric of 32 gauge, and made from 100 polyester yarn of between 20 and 40 gauge, works effectively. This fabric has a yield of approximately 4.10 ounces per linear yard, and is typically provided in 60 inch width. In the preferred form of the invention, the bag size serving as the dispenser for the clay dust, is a rectangular-shaped, closed bag having a length of 4 inches and a width of 3 inches, which dimensions, it has been found, offer the best grasping size for differently-sized hands, so that differently-sized hands may still be able to grasp and shake the bag, and allow the clay dust to emanate effectively for drying. While in the preferred embodiment 32 gauge fabric has been indicated, it is to be understood that other gauges thereof may be used, preferably within the range of between 28 gauge and 36 gauge tricot, knitted fabric. Further, the yarn, size is preferably within the range of between 15 denier and 45 denier. Further, other manmade yarns may be used, besides polyester, and any combinations thereof, which manmade yarns preferably have inferior moisture-absorption characteristics. The friable, non-sticky, clay particulates contained in the bag structure are allowed to escape via the porous strcuture of the 32 gauge tricot knitted fabric, with the flow rate thereof being substantially constant regardless of the amount of shaking or vibration of the bag, since the pores through which the dust flows are minute and regularly spaced, although the length of time such dust particles will effuse will be directly proportional to the amount and force of shaking and vibrating of the bag.

The bag itself is formed by first taking a rectangular piece of the fabric having a length of 7 inches and a width of 5 inches, and folding the piece such that the fold line lies parallel to the two, shorter five-inch sides thereof. Thereafter, the doubled-over piece is sewn along most of the perimeter thereof to stitch the folded-over upper layer and lower layer together along most of the circumference thereof, with a small opening being provided through which is poured the friable clay particulates, after which, the opening is sewn together to thus close off the bag entirely, and form the rectangularly-shaped. For a bag of four inches by three inches, as measured between stitch lines thereof which define the interior, capacity-holding portion of the bag, it has been found that between 2.25 ounces and 3.50 ounces of the friable clay particulates, described below in detail, is required to provide the moisture-absorption qualities needed for the bag, so as to ensure that enough fine effluent dust emanates through the pores of the knitted fabric for an average vibration or shaking of the bag lasting approximately between five and ten seconds, such average being that defined by a male bowler.

The friable clay contained in the tricot, knitted fabric bag is fuller's earth sericitic clay and has the following composition, by weight:

Silica ($SiO_2$): 80.40%
Aluminum Oxide ($Al_2O_3$): 9.48%
Iron Oxide ($Fe_2O_3$): 0.88%
Calcium Oxide (CaO): 0.20%
Magnesium Oxide (MgO): 0.54%
Sodium & Potassium Oxide ($R_2$): 0.15%
Combined water: 8.35%

Fuller's earth clay is a sorptive clay, which selectively collects and concentrates onto solid surfaces particular types of molecules contained in a liquid or gas. There are two basic mineral types of fuller's earth: Attapulgite, and Montmorillonite. Montmorillonite is: $X_y Al_2 (Al_y Si_{4-y} O_{10})(OH_2)$, where X is usually Na, Mg, or Al. The Attapulgus type is a crystalline hydrated magnesium aluminum silicate yielding high surface areas of porous material, and consists of:

$SiO_2$: 55.03%
$Al_2O_3$: 10.24%
$Fe_2O_3$: 3.53%
MgO: 10.49%
$K_2O$: 0.47%;

$H_2O$ removed at 110 degrees C. is 9.73%, while above 150 degrees C. 10.13%;

Either form of fuller's earth may be used in the present invention and combined with sericite, as set forth below.

Sericite is a scaly variety of muscovite mineral with the following formula:

$$K\ Al_3\ Si_3\ O_{10}\ (OH)_2.$$

Fuller's earth sericitic is a commercially-available product. The preferred size of each particulate of the sericitic is between approximately one-quarter and one-eight of an inch, which has been found to provide the fine dust-like particles after only moderate shaking and vibrating of the container bag.

While a specific embodiment of the invention has been shown and described, it is to be understood that numerous changes and modifications thereof may be made without deparrting from the scope, spirit, and intent of the invention as set out in the appended claims.

What is claimed is:

1. A bowler's aid for drying the bowling hand, comprising:

a container bag made from tricot knitted fabric having a gauge of between 28 and 36, said fabric being made of 100% manmade fibers having a yarn size of between 15 and 45 denier, said bag being substantially closed off and providing minute pores through which may escape a dust contained in said bag;

and fuller's earth sericitic contained in said container bag for escape through said minute pores when said container bag is shaken and vibrated, whereby when said bag is held in a hand and shaken, a fine dust is caused to effuse through said pores to dry the hand from moisture.

2. The bowler's aid according to claim 1, wherein said fabric has a yield of approximately 4.10 ounces per linear yard.

3. The bowler's aid according to claim 2, wherein said yarn is polyester.

4. The bowler's aid according to claim 3, wherein said bag is substantially rectangular in shape and is approximately 7 inches long and 5 inches wide.

5. The bowler's aid according to claim 4, wherein said fuller's earth sericitic in said bag is supplied in a range from between approximately 2.25 ounces and 3.50 ounces.

6. The bowler's aid according to claim 5, wherein said fuller's earth sericitic comprises particle sizes of between one-fourth and one-eighth of an inch.

7. A method of drying a hand with fuller's earth sericitic, comprising:

(a) forming a substantially closed bag and leaving a small opening therein through which may be poured a substance;

(b) filling the interior of the bag with fuller's earth sericitic;

(c) closing off the small opening from said step (a) after said step (b);

(d) said step of forming comprising making a bag from a knitted fabric having pores therein through which may effuse the contents of the bag provided therein from said step (b);

(e) holding the closed, filled bag in a hand and shaking the bag to cause the fuller's earth sericitic therein to become dust and escape through the pores of the knitted fabric to thereby adsorb the moisture on the hand.

8. The method according to claim 7, wherein said step (d) comprises choosing a 2-bar, tricot knitted fabric having a gauge between 28 and 36 made from 100% manmade fibers having a size from between 15 denier and 45 denier.

* * * * *